US010164375B1

(12) United States Patent
Xie et al.

(10) Patent No.: US 10,164,375 B1
(45) Date of Patent: Dec. 25, 2018

(54) PLUG CONNECTOR

(71) Applicant: Cheng Uei Precision Industry Co., Ltd., New Taipei (TW)

(72) Inventors: Shi-Mao Xie, Dong-Guan (CN); Bo Liu, Dong-Guan (CN); Feng Zhu, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/965,958

(22) Filed: Apr. 29, 2018

(51) Int. Cl.

| | |
|---|---|
| ***H01R 24/00*** | (2011.01) |
| ***H01R 13/627*** | (2006.01) |
| ***H01R 13/6581*** | (2011.01) |
| ***H01R 13/424*** | (2006.01) |
| ***H01R 13/506*** | (2006.01) |

(52) U.S. Cl.
CPC ..... *H01R 13/6272* (2013.01); *H01R 13/424* (2013.01); *H01R 13/506* (2013.01); *H01R 13/6581* (2013.01)

(58) Field of Classification Search
CPC ..... H01R 13/641; H01R 24/64
USPC ..... 439/676, 489, 955
See application file for complete search history.

(56) References Cited

U.S. PATENT DOCUMENTS 1,481,368 A * 1/1924 Hope ..... H01R 13/453 174/67
4,506,944 A * 3/1985 Brennan ..... H01R 13/6581 439/418
4,516,825 A * 5/1985 Brennan ..... H01R 13/6581 439/422
5,224,868 A * 7/1993 Tseng ..... H01R 13/4534 439/136
5,382,182 A * 1/1995 Shen ..... H01R 24/62 439/425
5,415,570 A * 5/1995 Sarkissian ..... H01R 24/62 439/660
6,004,147 A * 12/1999 Don-Yehiya ..... G02B 6/3849 439/138
6,126,610 A * 10/2000 Rich ..... A61M 16/0051 128/204.23
6,287,133 B1 * 9/2001 Yang ..... H01R 13/4536 439/138

(Continued)

*Primary Examiner* — Neil Abrams
(74) *Attorney, Agent, or Firm* — Cheng-Ju Chiang

(57) ABSTRACT

A plug connector includes an insulating housing, a plurality of detecting terminals, a plurality of connection terminals, an outer shell and at least one ground piece. The insulating housing has a plurality of connection terminal grooves and a plurality of detecting terminal grooves. The plurality of the detecting terminals are assembled in the plurality of the detecting terminal grooves separately. The plurality of the connection terminals are assembled in the plurality of the connection terminal grooves separately. The outer shell surrounds the insulating housing. A top surface of the outer shell protrudes upward and then is bent frontward to form a locking portion. The at least one ground piece is mounted to at least one side of the insulating housing, and a portion of the at least one ground piece is exposed outside from the insulating housing and the outer shell. A receptacle connector is to receive the plug connector and includes a sliding block to cover the detecting terminals and to be raised by the plug connector as it is inserted.

16 Claims, 9 Drawing Sheets

(56) References Cited

U.S. PATENT DOCUMENTS 6,588,938 B1 * 7/2003 Lampert ..... G02B 6/3817 385/58
6,688,910 B1 * 2/2004 Macauley ..... H04Q 1/136 379/326
6,790,097 B1 * 9/2004 Edwards ..... H01R 13/6485 439/181
6,817,890 B1 * 11/2004 Schindler ..... H04Q 1/136 439/490
7,193,422 B2 * 3/2007 Velleca ..... H01R 13/6691 324/538
7,352,285 B2 * 4/2008 Sakama ..... G06K 7/10178 340/539.1
7,431,600 B2 * 10/2008 Kozak ..... H01R 13/502 439/181
7,534,137 B2 * 5/2009 Caveney ..... H04Q 1/136 439/540.1
7,605,707 B2 * 10/2009 German ..... H01R 13/465 340/572.7
7,674,126 B2 * 3/2010 Below ..... H01R 13/2407 439/489
7,695,309 B2 * 4/2010 Craig ..... H05K 7/186 439/489
7,758,382 B2 * 7/2010 Hiratsuka ..... H01R 13/6485 439/607.34
7,938,700 B2 * 5/2011 Jacks ..... H01R 13/641 439/88
8,142,221 B2 * 3/2012 Malstron ..... H01R 13/665 439/489
8,388,386 B2 * 3/2013 Petersen ..... H01R 43/20 439/620.22
8,480,438 B2 * 7/2013 Mattson ..... H01R 13/641 439/676
8,894,296 B2 * 11/2014 Peto ..... H01R 24/60 385/53
8,992,260 B2 * 3/2015 Coffey ..... H01R 13/641 439/620.22
9,093,796 B2 * 7/2015 Taylor ..... H01R 13/703
9,285,552 B2 * 3/2016 Marcouiller ..... G02B 6/3817
9,379,501 B2 * 6/2016 Taylor ..... H04Q 1/13
9,417,399 B2 * 8/2016 Anderson ..... G02B 6/3825
2017/0272841 A1 * 9/2017 Ding ..... H04Q 1/06

* cited by examiner

PLUG CONNECTOR

BACKGROUND OF THE INVENTION

1. Field of the Invention

The present invention generally relates to a connector, and more particularly to a plug connector having a detecting function.

2. The Related Art

Nowadays, a connector is used widely and widely. A conventional plug connector includes a plurality of contact elements, an insulating housing and an outer shell. The contact elements are core components of the conventional plug connector accomplishing an electrical connection function. An effect of the insulating housing is to make the contact elements arranged according to needed positions and an interval between each two contact elements to ensure an insulating performance among the plurality of the contact elements, and an insulating performance between the plurality of the contact elements and the outer shell. The outer shell is an outer cover of the conventional plug connector. The outer shell provides mechanical protections of an insulating mounting plate and a pin assembled in the conventional plug connector, and provides an alignment of the conventional plug connector and a receptacle connector at the time of the conventional plug connector matching with the receptacle connector, the conventional plug connector is fixed to an equipment.

However, with developments of science and technology, an evolution of big data, in information transmission, a more stable and faster transmission capacity is needed, a transmission function of the above-mentioned conventional plug connector is incapable of dealing with needs of times.

Thus, an innovative plug connector is essential to be provided, the innovative plug connector increases a new component so as to make the innovative plug connector have a detecting function, and a performance of the innovative plug connector is enhanced for reaching a more stable and faster transmission capacity.

SUMMARY OF THE INVENTION

An object of the present invention is to provide a plug connector adapted for being docked with a receptacle connector. The receptacle connector opens an accommodating space penetrating through a rear surface of the receptacle connector. The plug connector is inserted into the accommodating space. The receptacle connector includes a plurality of conductive terminals disposed to a front of the accommodating space, a plurality of docking terminals disposed to a lower portion of the accommodating space, and at least one ground slice having a touching portion exposed in the accommodating space. A front of a top wall of the accommodating space is recessed away from a center of the receptacle connector to form a locking groove. The plug connector includes an insulating housing, a plurality of detecting terminals, a plurality of connection terminals, an outer shell and at least one ground piece. A lower portion of a front end of the insulating housing has a plurality of connection terminal grooves. An upper portion of the front end of the insulating housing has a plurality of detecting terminal grooves projecting beyond front ends of the plurality of the connection terminal grooves. The plurality of the detecting terminals are assembled in the plurality of the detecting terminal grooves separately and front ends of the plurality of the detecting terminals project beyond a front surface of the insulating housing. The front ends of the plurality of the detecting terminals contact the plurality of the conductive terminals. The plurality of the connection terminals are assembled in the plurality of the connection terminal grooves separately, and lower portions of front ends of the plurality of the connection terminals are exposed to the lower portion of the front end of the insulating housing. The lower portions of the front ends of the plurality of the connection terminals contact the plurality of docking terminals. The outer shell surrounds the insulating housing. A top surface of the outer shell protrudes upward and then is bent frontward to form a locking portion matched with the locking groove. The at least one ground piece is mounted to at least one side of the insulating housing, and a portion of the at least one ground piece is exposed outside from the insulating housing and the outer shell. The portion of the at least one ground piece contacts the touching portion of the at least one ground slice.

As described above, comparing the plug connector with the conventional plug connector, the plug connector newly increases the plurality of the detecting terminals to make the plug connector have a detecting function, a connection between the plurality of the connection terminals of the plug connector and the plurality of the docking terminals of the receptacle connector is ensured and a transmission efficiency is improved by virtue of a cooperation of the plurality of the detecting terminals and the plurality of the connection terminals, and an anti-interference performance and a transmission stability of the plug connector are enhanced by virtue of the plug connector newly increasing the at least one ground piece for reaching a more stable and faster transmission capacity. Furthermore, a fastening capacity between the plug connector and the receptacle connector is intensified by virtue of the locking portion and the locking groove. In addition, a manufacturing and assembling process of the plug connector is simpler by virtue of a front-to-rear separation type design of the insulating housing and the outer shell.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
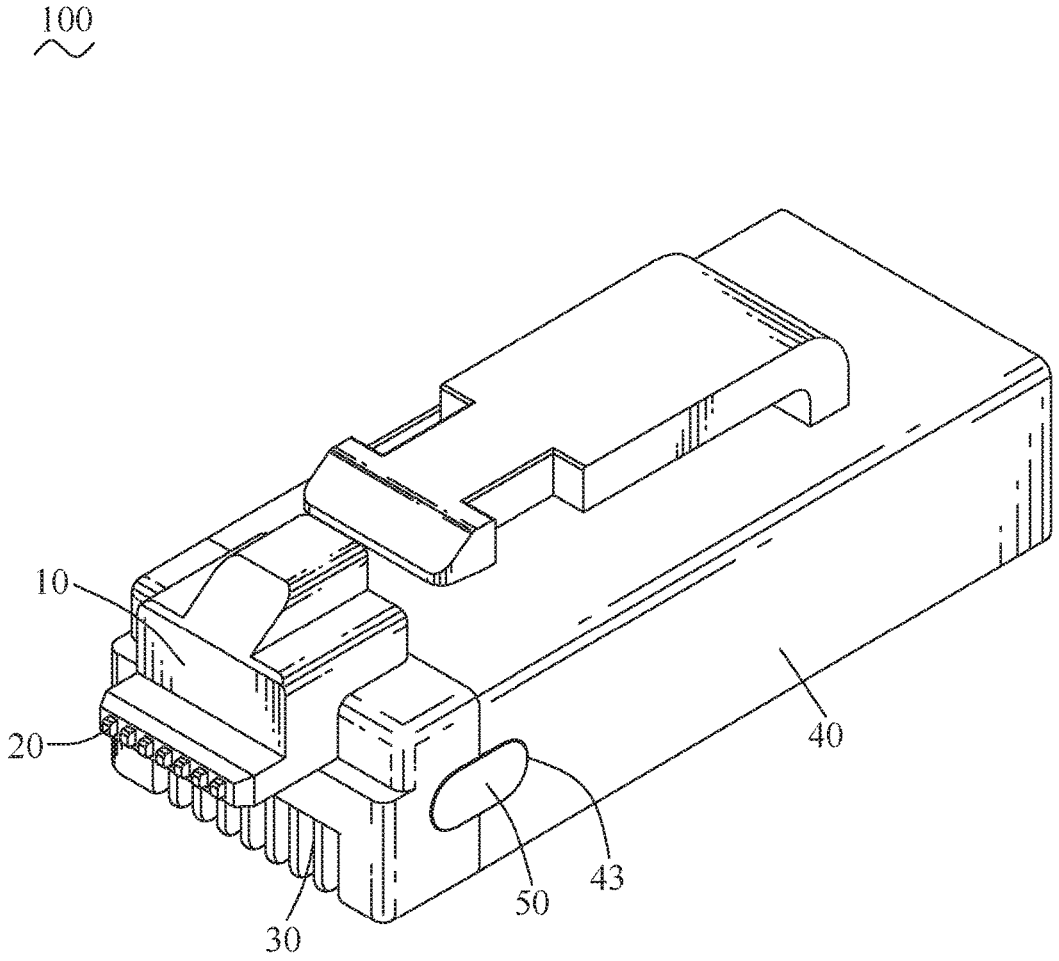
FIG. 1 is a perspective view of a plug connector in accordance with a preferred embodiment of the present invention.

With reference to FIG. 1, a plug connector 100 in accordance with a preferred embodiment of the present invention is shown. The plug connector 100 includes an insulating housing 10, a plurality of detecting terminals 20, a plurality of connection terminals 30, an outer shell 40 and at least one ground piece 50. In this preferred embodiment, the plug connector 100 includes two ground pieces 50.

Figure 2:
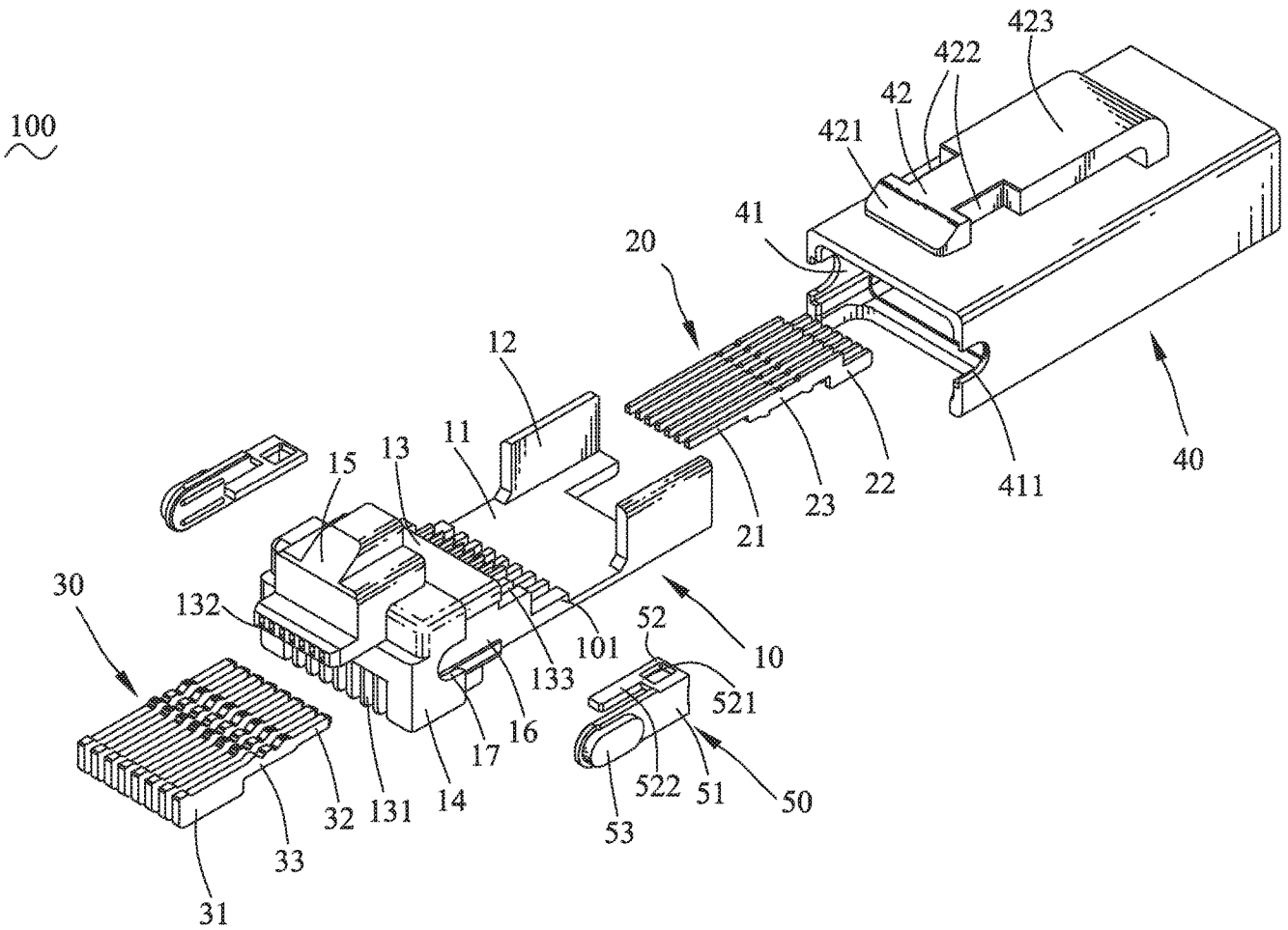
FIG. 2 is an exploded view of the plug connector of FIG. 1.
Figure 3:
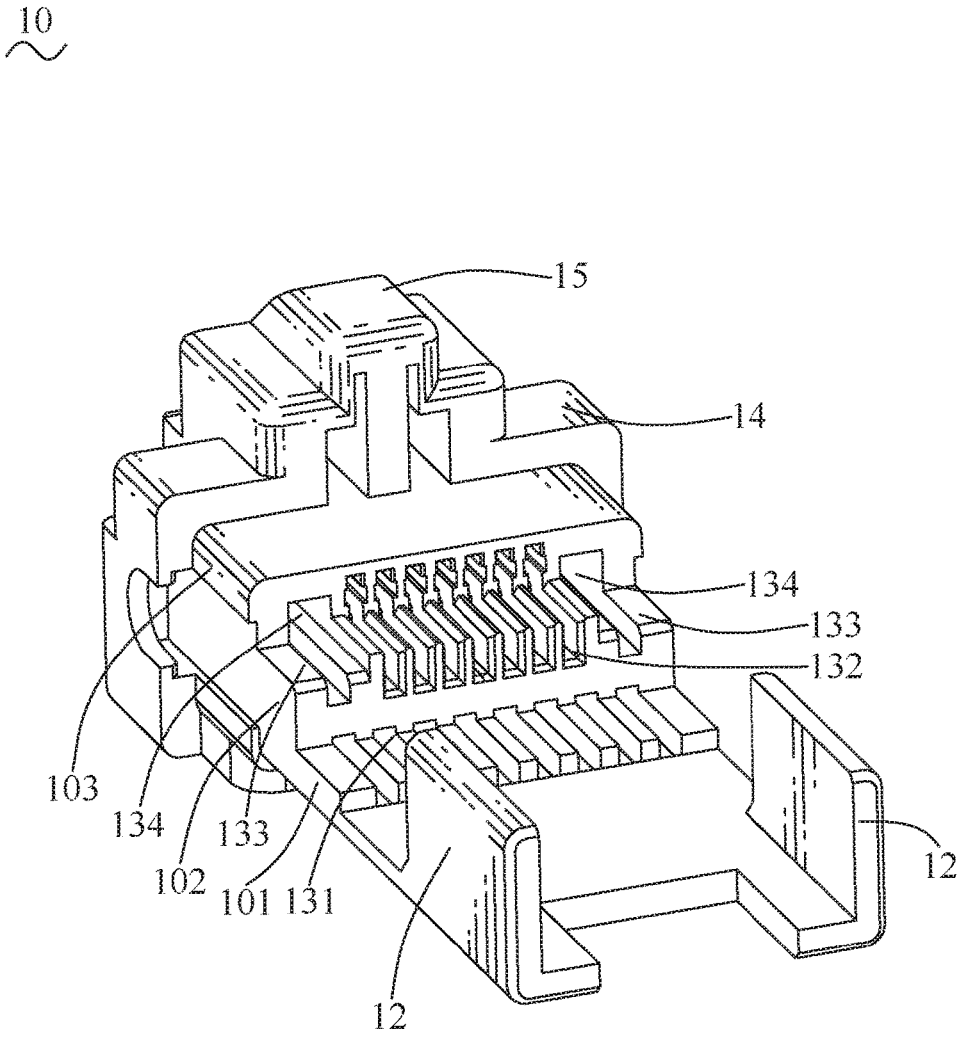
FIG. 3 is a perspective view of an insulating housing of the plug connector of FIG. 2.
Figure 4:
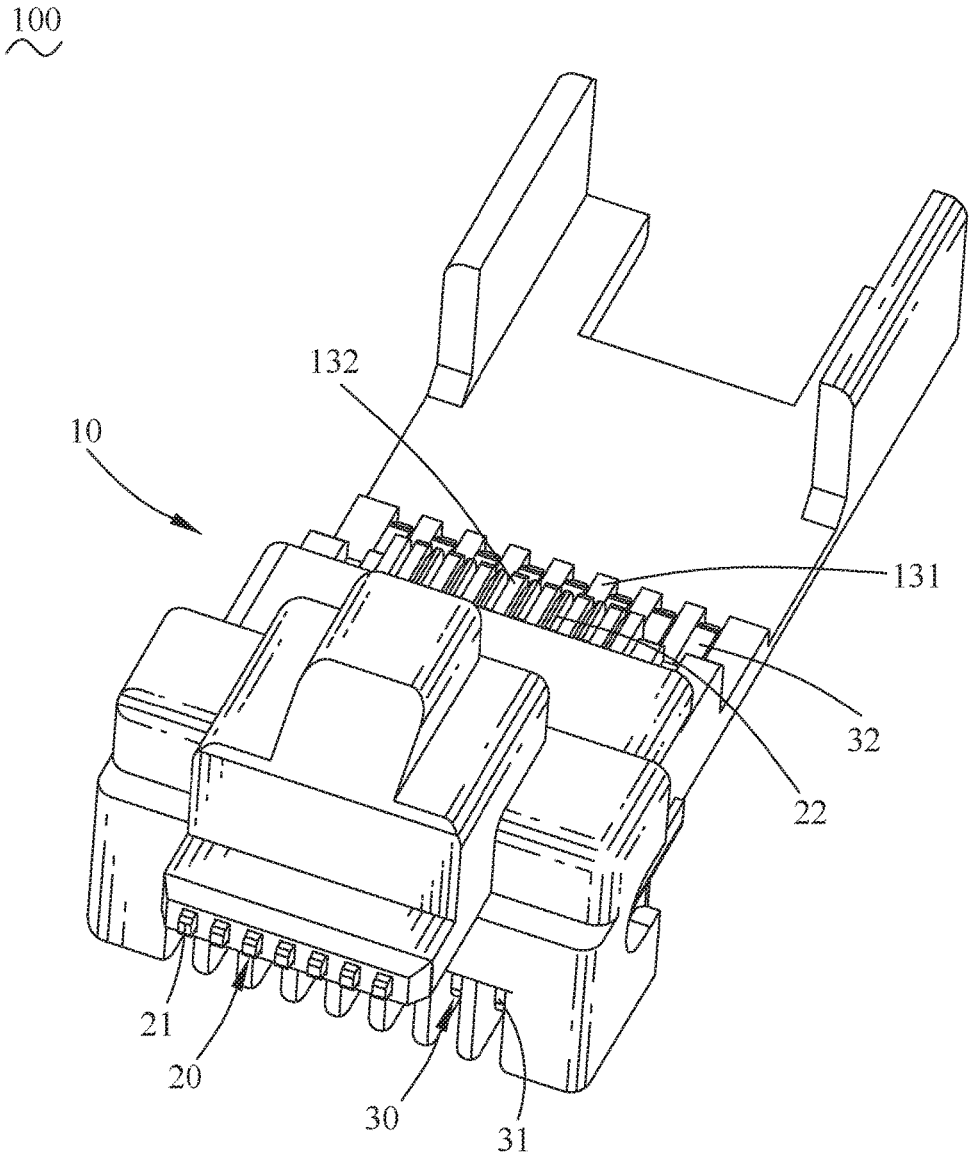
FIG. 4 is an assembling perspective view showing that the insulating housing and a plurality of terminals of the plug connector of FIG. 2.
Figure 5:
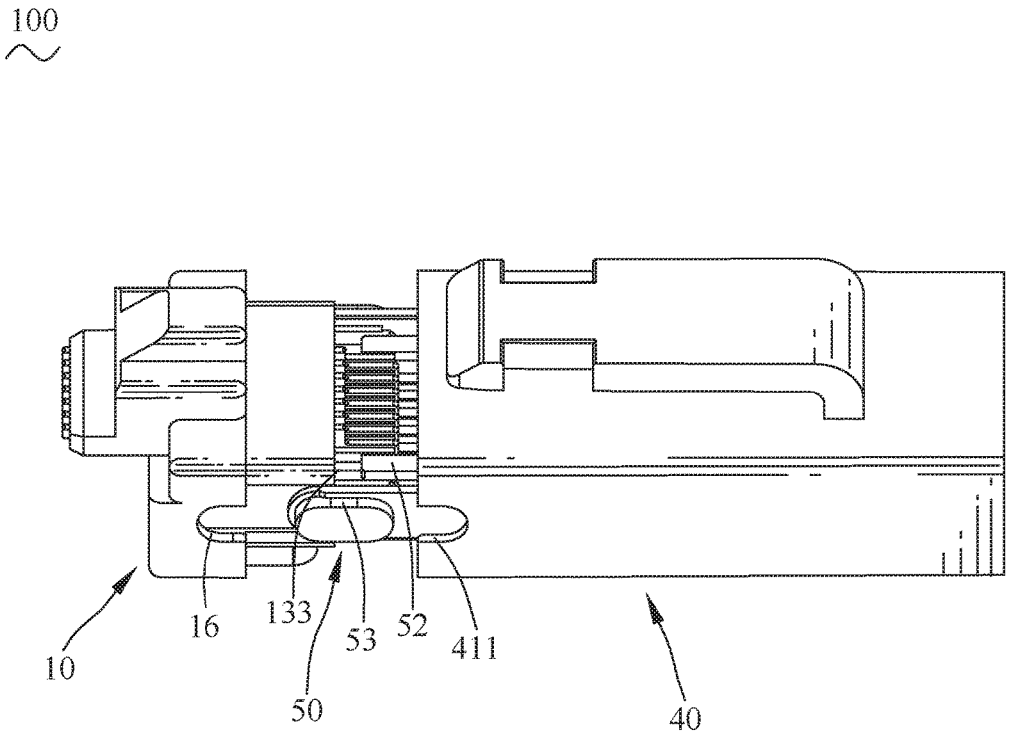
FIG. 5 is an assembling perspective view showing that the insulating housing, at least one ground element and an outer shell of the plug connector of FIG. 2.
Figure 6:
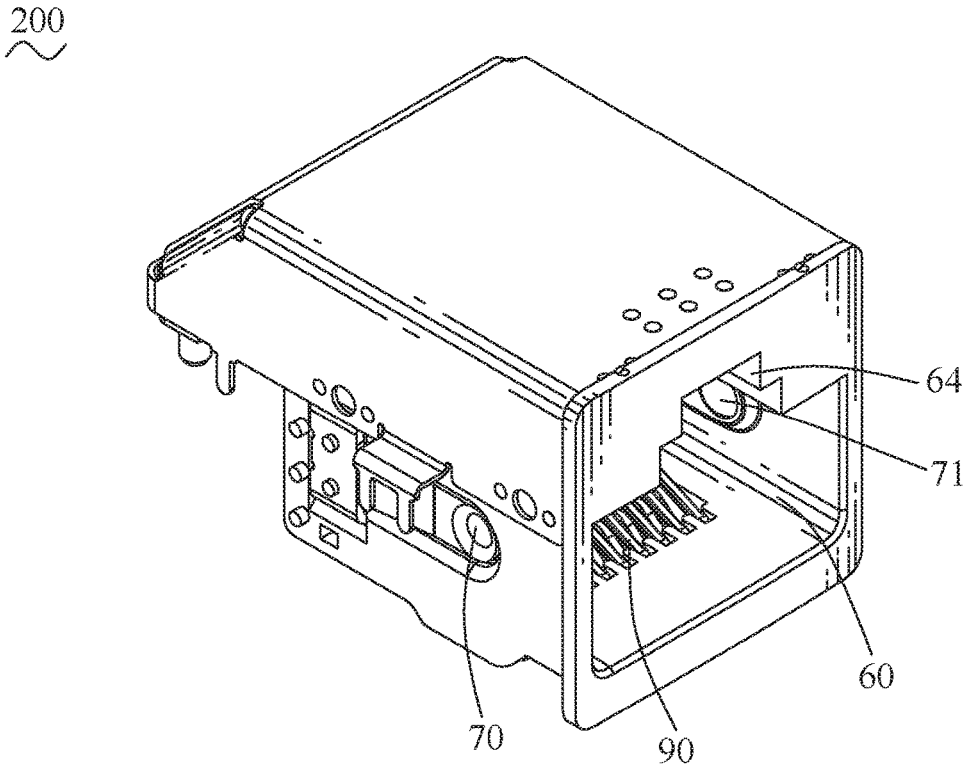
FIG. 6 is a perspective view of a receptacle connector matched with the plug connector in accordance with the preferred embodiment of the present invention.
Figure 7:
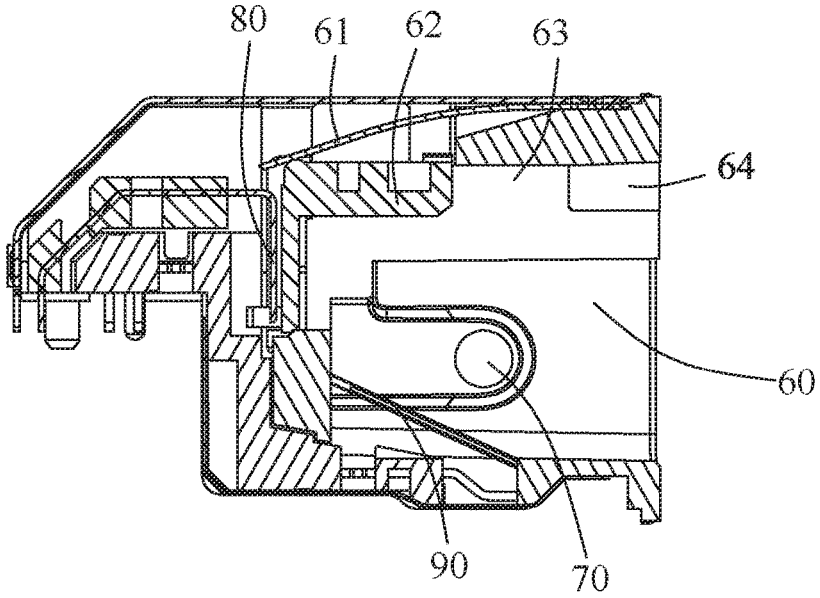
FIG. 7 is a sectional view of the receptacle connector of FIG. 6.
Figure 8:
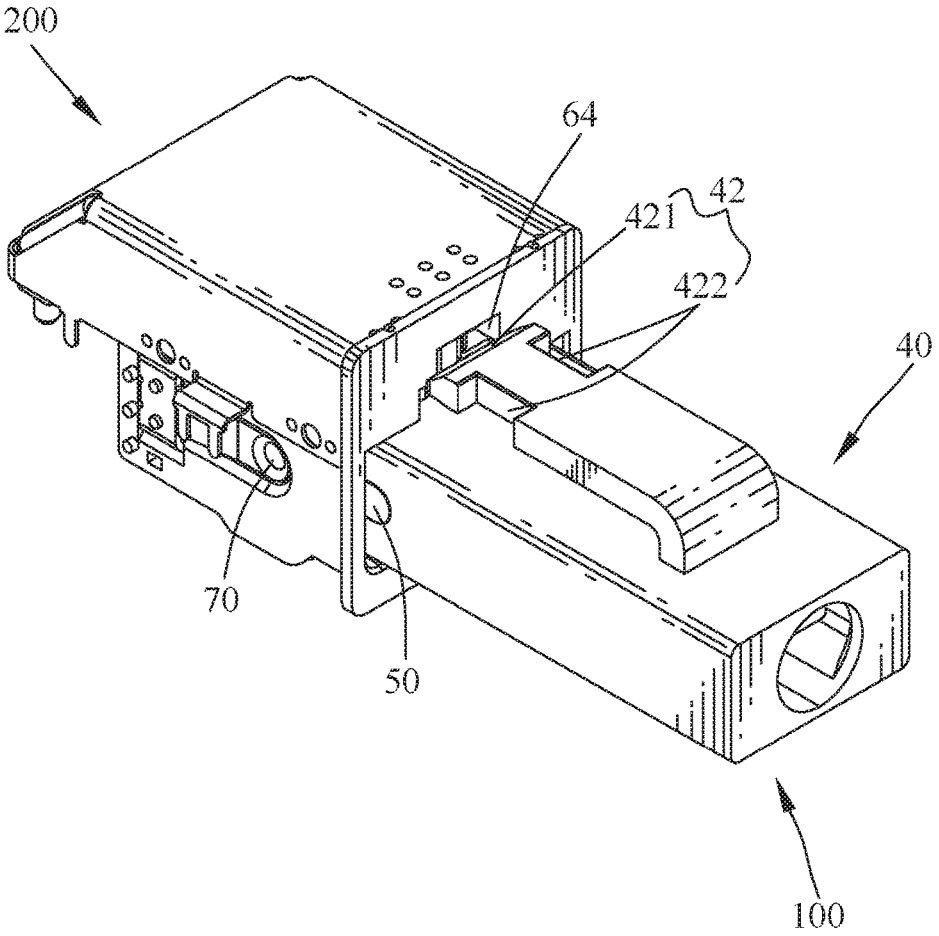
FIG. 8 is an assembling perspective view showing that the receptacle connector and the plug connector of FIG. 1.
Figure 9:
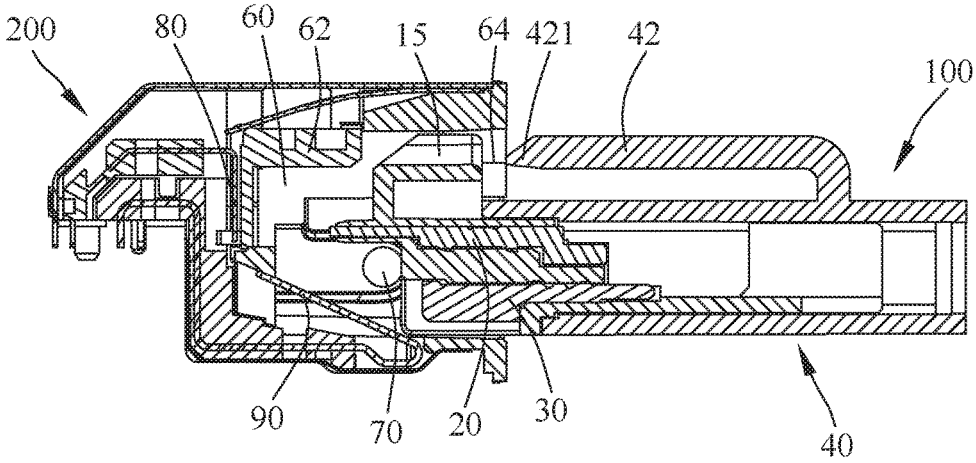
FIG. 9 is a sectional view of the assembling perspective view of the receptacle connector and the plug connector of FIG. 8.

Referring to FIG. 2 to FIG. 4, the insulating housing 10 has a first base portion 11. Two opposite sides of a rear end of the first base portion 11 protrude upward to form two fastening boards 12. A top of a front end of the first base portion 11 protrudes upward to form a stair-shaped fastening holder 13. The fastening holder 13 has a first step 101 protruded upward from the top of the front end of the first base portion 11, a second step 102 protruded upward from a top of a front end of the first step 101, and a third step 103 protruded upward from a top of a front end of the second step 102. A lower portion of the front end of the first base portion 11 extends frontward to form a head portion 14. Two opposite sides of the head portion 14 project beyond two opposite side surfaces of the fastening holder 13. A top of the head portion 14 protrudes upward to form a convex portion 15 projecting beyond a front surface of the head portion 14. A junction between a top surface and a front surface of the convex portion 15 is chamfered, so the top surface of the convex portion 15, the junction between the top surface and the front surface of the convex portion 15, and the front surface of the convex portion 15 show a substantial C shape. A lower portion of a front end of the insulating housing 10 has a plurality of connection terminal grooves 131 arranged transversely. An upper portion of the front end of the insulating housing 10 has a plurality of detecting terminal grooves 132 projecting beyond front ends of the plurality of the connection terminal grooves 131 and arranged transversely. A lower portion of the fastening holder 13 defines the plurality of the connection terminal grooves 131 arranged transversely. A middle of the fastening holder 13 defines the plurality of the detecting terminal grooves 132 and at least one first fastening groove 133 arranged transversely. The at least one first fastening groove 133 is located between the plurality of the detecting terminal grooves 132 and one side surface of the fastening holder 13. An inner side of the at least one first fastening groove 133 extends frontward into the third step 103 of the fastening holder 13 to form at least one insertion groove 134.

The fastening holder 13 defines a plurality of connection terminal grooves 131 penetrating upward through a top surface of the first step 101, penetrating downward through a front end of a bottom surface of the insulating housing 10, and penetrating frontward through a lower portion of the second step 102 and the front surface of the head portion 14. The fastening holder 13 defines a plurality of detecting terminal grooves 132 penetrating upward through a middle of a top surface of the second step 102 and penetrating frontward through the third step 103 and a front surface of the convex portion 15. At least one side of the top surface of the second step 102 is recessed downward to form the at least one first fastening groove 133. The insulating housing 10 defines at least one second fastening groove 16 extending longitudinally and projecting into a rear of at least one side of the head portion 14. A middle of a front of the at least one second fastening groove 16 extends outward to form at least one first limiting groove 17 penetrating through at least one outer surface of the head portion 14 away from a center of the insulating housing 10. A front inner wall of the at least one first limiting groove 17 is arched frontward to show an arc shape.

In the preferred embodiment, two opposite sides of the top surface of the second step 102 are recessed downward to form two first fastening grooves 133. Two opposite sides of the insulating housing 10 define two second fastening grooves 16 extending longitudinally and projecting into rears of the two opposite sides of the head portion 14. Middles of fronts of the two second fastening grooves 16 extend outward to form two first limiting grooves 17 penetrating through two outer surfaces of the head portion 14 away from the center of the insulating housing 10. The front inner wall of each of the two first limiting grooves 17 is arched frontward to show the arc shape. Inner sides of the two first fastening grooves 133 extend frontward into the third step 103 of the fastening holder 13 to form two insertion grooves 134.

Referring to FIG. 2 to FIG. 4 again, the plurality of the detecting terminals 20 and the plurality of the connection terminals 30 are assembled to the insulating housing 10. The plurality of the connection terminals 30 are assembled in the plurality of the connection terminal grooves 131 separately, and lower portions of front ends of the plurality of the connection terminals 30 are exposed to the lower portion of the front end of the insulating housing 10. Each of the plurality of the connection terminals 30 has a second connecting portion 33, a second contact portion 31 extended frontward from a front end of the second connecting portion 33, and a second fastening portion 32 extended rearward from a rear end of the second connecting portion 33. The second contact portions 31 of the plurality of the connection terminals 30 penetrate through the plurality of the connection terminal grooves 131 and project beyond the front surface of the head portion 14 through front ends of the plurality of the connection terminal grooves 131. The second fastening portions 32 of the plurality of the connection terminals 30 are fastened to and are exposed from rear ends of the plurality of the connection terminal grooves 131 and are exposed outside from the top surface of the first step 101. The second connecting portions 33 of the plurality of the connection terminals 30 are fastened in middles of the plurality of the connection terminal grooves 131, so that the plurality of the connection terminals 30 are fastened in the plurality of the connection terminal grooves 131.

The plurality of the detecting terminals 20 are assembled in the plurality of the detecting terminal grooves 132 separately, and front ends of the plurality of the detecting terminals 20 project beyond a front surface of the insulating housing 10. Each of the plurality of the detecting terminals 20 has a first connecting portion 23, a first contact portion 21 extended frontward from a front end of the first connecting portion 23, and a first fastening portion 22 extended rearward, then bent downward and further extended rearward from a rear end of the first connecting portion 23. The first contact portions 21 of the plurality of the detecting terminals 20 penetrate through the plurality of the detecting terminal grooves 132 and project beyond the front surface of the convex portion 15 through front ends of the plurality of the detecting terminal grooves 132. The first fastening portions 22 of the plurality of the detecting terminals 20 are fastened to and are exposed from rear ends of the plurality of the detecting terminal grooves 132 and are exposed outside from the top surface of the second step 102. The first connecting portions 23 of the plurality of the detecting terminals 20 are fastened in middles of the plurality of the detecting terminal grooves 132. Cables (not shown) are soldered to the plurality of the connection terminals 30 and the plurality of the detecting terminals 20 together with the insulating housing 10.

Referring to FIG. 1 to FIG. 4, the outer shell 40 surrounds the insulating housing 10. The outer shell 40 is of a substantially rectangular hollow shape from a top view. The insulating housing 10 is inserted rearward into the outer shell 40, so the insulating housing 10 and the outer shell 40 are a front-to-rear separation type design. The fastening holder 13 is received in the outer shell 40. The head portion 14 and the convex portion 15 are exposed out of the outer shell 40. The two fastening boards 12 are received in the outer shell 40. An inner surface of at least one side of a front end of the outer shell 40 is recessed away from a middle of the outer shell 40 to form at least one third fastening groove 41. A middle of a front edge of an outer side wall of the at least one third fastening groove 41 is recessed rearward to form at least one arc-shaped second limiting groove 411. In the preferred embodiment, inner surfaces of two opposite sides of the front end of the outer shell 40 are recessed oppositely to form two third fastening grooves 41. Middles of front edges of outer side walls of the two third fastening grooves 41 are recessed rearward to form two arc-shaped second limiting grooves 411. A top surface of the outer shell 40 protrudes upward and then is bent frontward to form a locking portion 42 having an elasticity. The locking portion 42 has a bending portion 423 connected with the top surface of the outer shell 40, and a tongue portion 421 protruded frontward from a middle of a front surface of the bending portion 423. Two opposite sides of a front end of the tongue portion 421 project beyond two opposite side surfaces of a rear end of the tongue portion 421. Each side of the front end of the tongue portion 421 is spaced from the front surface of the bending portion 423 to form a notch 422.

The at least one ground piece 50 is mounted to at least one side of the insulating housing 10, and a portion of the at least one ground piece 50 is exposed outside from the insulating housing 10 and the outer shell 40. The at least one ground piece 50 has a second base portion 51. A rear end of a top surface of the second base portion 51 extends towards the insulating housing 10 to form a fastening arm 52. The fastening arm 52 has a fastening piece 521 connected with the rear end of the top surface of the second base portion 51, and an insertion piece 522 extended frontward from an inner side of a front of the fastening piece 521. A front end of an outer side surface of the second base portion 51 away from the insulating housing 10 protrudes outward to form a ground plate 53. The ground plate 53 is of an elliptical shape.

In the preferred embodiment, the two ground pieces 50 are mounted to the two opposite sides of the insulating housing 10. Each of the two ground pieces 50 has the second base portion 51. The rear end of the top surface of the second base portion 51 extends towards the insulating housing 10 to form the fastening arm 52. The fastening arm 52 has the fastening piece 521 connected with the rear end of the top surface of the second base portion 51, and the insertion piece 522 extended frontward from the inner side of the front of the fastening piece 521. The front end of the outer side surface of the second base portion 51 away from the insulating housing 10 protrudes outward to form the elliptical ground plate 53.

Referring to FIG. 1 to FIG. 5 again, when the at least one ground piece 50 is assembled between the insulating housing 10 and the outer shell 40, the fastening arm 52 of the at least one ground piece 50 is fastened to the insulating housing 10 by virtue of the at least one first fastening groove 133 and the at least one insertion groove 134. The fastening arm 52 of the at least one ground piece 50 is fastened in the at least one first fastening groove 133. The fastening piece 521 of the fastening arm 52 of the at least one ground piece 50 is fastened in the at least one first fastening groove 133, and the insertion piece 522 of the fastening arm 52 of the at least one ground piece 50 is inserted into the at least one insertion groove 134. An inner side of the second base portion 51 of the at least one ground piece 50 is fastened in the at least one second fastening groove 16. The front inner wall of the at least one first limiting groove 17 is matched with a front end of the ground plate 53. The front end of ground plate 53 is limited in the at least one first limiting groove 17.

When the outer shell 40 is assembled with the insulating housing 10, the at least one arc-shaped second limiting groove 411 is matched with a rear end of the ground plate 53. The rear end of the ground plate 53 is fastened in the at least one second limiting groove 411. The at least one first limiting groove 17 is integrated with at least one arc-shaped second limiting groove 411 to form an elliptical restricting groove 43, so the ground plate 53 is restricted in the restricting groove 43. An outer side of the second base portion 51 of the at least one ground piece 50 is fixed in the at least one third fastening groove 41. So, the at least one ground piece 50 is assembled to the plug connector 100 by virtue of the at least one ground piece 50 being clamped between the at least one third fastening groove 41 and the at least one second fastening groove 16.

Referring to FIG. 1 to FIG. 9, the plug connector 100 is adapted for being docked with a receptacle connector 200. The receptacle connector 200 opens an accommodating space 60 penetrating through a rear surface of the receptacle connector 200. The plug connector 100 is inserted into the accommodating space 60 of the receptacle connector 200. The accommodating space 60 is defined as a docking mouth. The receptacle connector 200 includes a plurality of conductive terminals 80 disposed to a front of the accommodating space 60, and a plurality of docking terminals 90 disposed to a lower portion of the accommodating space 60. A front of a top wall of the accommodating space 60 is recessed away from a center of the receptacle connector 200 to form an inverted-T shaped locking groove 64. The locking portion 42 is matched with the locking groove 64. The top wall of the accommodating space 60 defines a buckling groove 63 adjacent to an inner end of the locking groove 64. A top surface of the top wall of the accommodating space 60 is equipped with a resilient piece 61. The receptacle connector 200 has a sliding block 62 corresponding to and abutting against a bottom of the resilient piece 61. The sliding block 62 is capable of being pushed to move upward and downward. A junction between a rear surface and a bottom surface of a rear end of the sliding block 62 is chamfered. The junction between the top surface and the front surface of the convex portion 15 is matched with the junction between the rear surface and the bottom surface of the rear end of the sliding block 62. When the sliding block 62 is without being pushed to move upward, the sliding block 62 is just capable of shielding the plurality of the conductive terminals 80 disposed in the receptacle connector 200. In addition, the receptacle connector 200 further includes at least one ground slice 70 disposed to at least one side wall of the receptacle connector 200. The at least one ground slice 70 has a touching portion 71 exposed in the accommodating space 60. In the preferred embodiment, the receptacle connector 200 further includes two ground slices 70 disposed to two side walls of the receptacle connector 200. Each of the two ground slices 70 has the touching portion 71 exposed in the accommodating space 60.

Referring to FIG. 1 to FIG. 9 again, in a process of the plug connector 100 being docked with and inserted into the receptacle connector 200, the convex portion 15 of the head portion 14 of the plug connector 100 will prop up the sliding block 62 of the accommodating space 60 of the receptacle connector 200 in advance to make the sliding block 62 to move upward, the plurality of the conductive terminals 80 of the receptacle connector 200 will be exposed to the accommodating space 60 by virtue of the sliding block 62 moving upward to make the front ends of the plurality of the detecting terminals 20 of the plug connector 100 further contact the plurality of the conductive terminals 80 of the receptacle connector 200 so as to make a conduction between the plurality of the detecting terminals 20 and the plurality of the conductive terminals 80 successfully. When the plug connector 100 continues being inserted into the accommodating space 60 of the receptacle connector 200, the front end of the tongue portion 421 of the locking portion 42 of the outer shell 40 will show a pressing status on account of the tongue portion 421 being pressed by the locking groove 64.

When the plug connector 100 continues being inserted to a bottom of the accommodating space 60 of the receptacle connector 200, upper portions of two side walls of the locking groove 64 of the receptacle connector 200 will be buckled in the two notches 422 of the locking portion 42, so that the tongue portion 421 of the plug connector 100 is returned to an original position by an elasticity of a material of the tongue portion 421. The tongue portion 421 is buckled in the buckling groove 63, so the plug connector 100 is fastened to the receptacle connector 200 for preventing the plug connector 100 dropping out from the receptacle connector 200, at the moment, the lower portions of the front ends of the plurality of the connection terminals 30 of the plug connector 100 contact the plurality of the docking terminals 90 of the receptacle connector 200 to make a conduction between the plurality of the connection terminals 30 and the plurality of docking terminals 90. The portion of the at least one ground piece 50 contacts the touching portion 71 of the at least one ground slice 70. The ground plate 53 of the at least one ground piece 50 of the plug connector 100 contacts the touching portion 71 of the at least one ground slice 70 of the accommodating space 60 of the receptacle connector 200 to make a conduction between the at least one ground piece 50 and the at least one ground slice 70 exposed in the accommodating space 60 of the receptacle connector 200. The ground plates 53 of the two ground pieces 50 of the plug connector 100 contact the touching portions 71 of the two ground slices 70 of the accommodating space 60 of the receptacle connector 200 to make a conduction between each of the two ground pieces 50 and one of the two ground slices 70 exposed in the accommodating space 60 of the receptacle connector 200. So, an anti-interference performance of the plug connector 100 is enhanced.

When the plug connector 100 is withdrawn from the receptacle connector 200, the locking portion 42 of the outer shell 40 is pressed downward in advance to make the tongue portion 421 of the plug connector 100 break away from the buckling groove 63 of the receptacle connector 200, so that the tongue portion 421 is able to pass through the locking groove 64, at the moment, the plurality of the detecting terminals 20 of the plug connector 100 break away from the plurality of the conductive terminals 80 of the receptacle connector 200, when the plug connector 100 continues being withdrawn outward, the plurality of the connection terminals 30 of the plug connector 100 break away from and disconnect the plurality of the docking terminals 90 of the receptacle connector 200, a total conduction between the plug connector 100 and the receptacle connector 200 is completely disconnected, at the moment, the plug connector 100 is withdrawn from the receptacle connector 200 completely.

As described above, comparing the plug connector 100 with the conventional plug connector, the plug connector 100 newly increases the plurality of the detecting terminals 20 to make the plug connector 100 have a detecting function, a connection between the plurality of the connection terminals 30 of the plug connector 100 and the plurality of the docking terminals 90 of the receptacle connector 200 is ensured and a transmission efficiency is improved by virtue of a cooperation of the plurality of the detecting terminals 20 and the plurality of the connection terminals 30, and the anti-interference performance and a transmission stability of the plug connector 100 are enhanced by virtue of the plug connector 100 newly increasing the at least one ground piece 50 for reaching a more stable and faster transmission capacity. Furthermore, a fastening capacity between the plug connector 100 and the receptacle connector 200 is intensified by virtue of the locking portion 42, the locking groove 64 and the buckling groove 63. In addition, a manufacturing and assembling process of the plug connector 100 is simpler by virtue of the front-to-rear separation type design of the insulating housing 10 and the outer shell 40.

What is claimed is:

1. A plug connector adapted for being docked with a receptacle connector, the receptacle connector opening an accommodating space penetrating through a rear surface of the receptacle connector, the plug connector being inserted into the accommodating space, the receptacle connector including a plurality of conductive terminals disposed to a front of the accommodating space, a plurality of docking terminals disposed to a lower portion of the accommodating space, and at least one ground slice having a touching portion exposed in the accommodating space, a front of a top wall of the accommodating space being recessed away from a center of the receptacle connector to form a locking groove, the plug connector comprising:

an insulating housing, a lower portion of a front end of the insulating housing having a plurality of connection terminal grooves, an upper portion of the front end of the insulating housing having a plurality of detecting terminal grooves projecting beyond front ends of the plurality of the connection terminal grooves;

a plurality of detecting terminals assembled in the plurality of the detecting terminal grooves separately, and front ends of the plurality of the detecting terminals projecting beyond a front surface of the insulating housing, the front ends of the plurality of the detecting terminals contacting the plurality of the conductive terminals;

a plurality of connection terminals assembled in the plurality of the connection terminal grooves separately, and lower portions of front ends of the plurality of the connection terminals being exposed to the lower portion of the front end of the insulating housing, the lower portions of the front ends of the plurality of the connection terminals contacting the plurality of docking terminals;

an outer shell surrounding the insulating housing, a top surface of the outer shell protruding upward and then being bent frontward to form a locking portion matched with the locking groove; and at least one ground piece mounted to at least one side of the insulating housing, and a portion of the at least one ground piece being exposed outside from the insulating housing and the outer shell, the portion of the at least one ground piece contacting the touching portion of the at least one ground slice.

2. The plug connector as claimed in claim 1, wherein the insulating housing has a first base portion, a top of a front end of the first base portion protrudes upward to form a stair-shaped fastening holder, a lower portion of the front end of the first base portion extends frontward to form a head portion, a top of the head portion protrudes upward to form a convex portion projecting beyond a front surface of the head portion, the outer shell is of a substantially hollow shape, the fastening holder is received in the outer shell, the head portion and the convex portion are exposed out of the outer shell.

3. The plug connector as claimed in claim 2, wherein a lower portion of the fastening holder defines the plurality of the connection terminal grooves arranged transversely and penetrating frontward through the front surface of the head portion, each of the plurality of the connection terminals has a second connecting portion, a second contact portion extended frontward from a front end of the second connecting portion, and a second fastening portion extended rearward from a rear end of the second connecting portion, the second contact portions of the plurality of the connection terminals penetrate through the plurality of the connection terminal grooves and project beyond the front surface of the head portion, the second fastening portions of the plurality of the connection terminals are fastened to and are exposed from rear ends of the plurality of the connection terminal grooves, the second connecting portions of the plurality of the connection terminals are fastened in middles of the plurality of the connection terminal grooves.

4. The plug connector as claimed in claim 2, wherein a middle of the fastening holder defines the plurality of the detecting terminal grooves arranged transversely and penetrating frontward through a front surface of the convex portion, each of the plurality of the detecting terminals has a first connecting portion, a first contact portion extended frontward from a front end of the first connecting portion, and a first fastening portion extended rearward, then bent downward and further extended rearward from a rear end of the first connecting portion, the first contact portions of the plurality of the detecting terminals penetrate through the plurality of the detecting terminal grooves and project beyond the front surface of the convex portion, the first fastening portions of the plurality of the detecting terminals are fastened to and are exposed from rear ends of the plurality of the detecting terminal grooves, the first connecting portions of the plurality of the detecting terminals are fastened in middles of the plurality of the detecting terminal grooves.

5. The plug connector as claimed in claim 2, wherein two opposite sides of a rear end of the first base portion protrude upward to form two fastening boards, the two fastening boards are received in the outer shell.

6. The plug connector as claimed in claim 2, wherein a top surface of the top wall of the accommodating space is equipped with a resilient piece, the receptacle connector has a sliding block corresponding to and abutting against a bottom of the resilient piece, in a process of the plug connector being docked with and inserted into the receptacle connector, the convex portion will prop up the sliding block in advance to make the sliding block to move upward, the plurality of the conductive terminals will be exposed to the accommodating space by virtue of the sliding block moving upward to make the front ends of the plurality of the detecting terminals further contact the plurality of the conductive terminals.

7. The plug connector as claimed in claim 6, wherein a junction between a top surface and a front surface of the convex portion is chamfered, a junction between a rear surface and a bottom surface of a rear end of the sliding block is chamfered, the junction between the top surface and the front surface of the convex portion is matched with the junction between the rear surface and the bottom surface of the rear end of the sliding block.

8. The plug connector as claimed in claim 2, wherein a middle of the fastening holder defines at least one first fastening groove located between the plurality of the detecting terminal grooves and one side surface of the fastening holder, the insulating housing defines at least one second fastening groove extending longitudinally and projecting into a rear of at least one side of the head portion, the at least one ground piece has a second base portion, a rear end of a top surface of the second base portion extends towards the insulating housing to form a fastening arm, the fastening arm is fastened in the at least one first fastening groove, an inner side of the second base portion is fastened in the at least one second fastening groove.

9. The plug connector as claimed in claim 8, wherein an inner side of the at least one first fastening groove extends frontward into the fastening holder to form at least one insertion groove, the fastening arm has a fastening piece connected with the rear end of the top surface of the second base portion, and an insertion piece extended frontward from an inner side of a front of the fastening piece, the fastening piece is fastened in the at least one first fastening groove, and the insertion piece is inserted into the at least one insertion groove.

10. The plug connector as claimed in claim 8, wherein a middle of a front of the at least one second fastening groove extends outward to form at least one first limiting groove penetrating through at least one outer surface of the head portion away from a center of the insulating housing, a front end of an outer side surface of the second base portion away from the insulating housing protrudes outward to form a ground plate, a front end of the ground plate is limited in the at least one first limiting groove.

11. The plug connector as claimed in claim 10, wherein a front inner wall of the at least one first limiting groove is arched frontward to show an arc shape, the ground plate is of an elliptical shape, the front inner wall of the at least one first limiting groove is matched with the front end of the ground plate.

12. The plug connector as claimed in claim 10, wherein an inner surface of at least one side of a front end of the outer shell is recessed away from a middle of the outer shell to form at least one third fastening groove, an outer side of the second base portion is fixed in the at least one third fastening groove.

13. The plug connector as claimed in claim 12, wherein a middle of a front edge of an outer side wall of the at least one third fastening groove is recessed rearward to form at least one arc-shaped second limiting groove, the at least one arc-shaped second limiting groove is matched with a rear end of the ground plate, the rear end of the ground plate is fastened in the at least one second limiting groove.

14. The plug connector as claimed in claim 1, wherein the locking portion has a bending portion connected with the top surface of the outer shell, and a tongue portion protruded frontward from a middle of a front surface of the bending portion, two opposite sides of a front end of the tongue portion project beyond two opposite side surfaces of a rear end of the tongue portion, each side of the front end of the tongue portion is spaced from the front surface of the bending portion to form a notch, when the plug connector continues being inserted to a bottom of the accommodating space of the receptacle connector, upper portions of two side walls of the locking groove will be buckled in the two notches of the locking portion.

15. The plug connector as claimed in claim 14, wherein the top wall of the accommodating space defines a buckling groove adjacent to an inner end of the locking groove, the tongue portion is buckled in the buckling groove.

16. The plug connector as claimed in claim 1, further comprising two ground pieces mounted to two opposite sides of the insulating housing.

* * * * *